US006508415B2

(12) United States Patent
Wang

(10) Patent No.: US 6,508,415 B2
(45) Date of Patent: Jan. 21, 2003

(54) SPRAY HEAD WITH A PIVOT NOZZLE

(76) Inventor: Tzu-Meng Wang, No. 91, Kwo-Tai Rd., Chu-Nan Chen, Miao-Li Hsien (TW)

( * ) Notice: Subject to any disclaimer, the term of this patent is extended or adjusted under 35 U.S.C. 154(b) by 1 day.

(21) Appl. No.: 09/859,404

(22) Filed: May 16, 2001

(65) Prior Publication Data

US 2002/0170983 A1 Nov. 21, 2002

(51) Int. Cl.[7] ..... B05B 15/08

(52) U.S. Cl. ..... 239/526; 239/587.1; 239/587.5; 285/184

(58) Field of Search ..... 239/289, 340, 239/437, 436, 442, 447, 525, 526, 530, 532, 587.1, 587.2, 587.5; 285/184, 283, 278, 280, 281

(56) References Cited

U.S. PATENT DOCUMENTS

| | | | | |
|---|---|---|---|---|
| 692,375 A | * | 2/1902 | Snider | 239/526 |
| 1,125,642 A | * | 1/1915 | Blanchard | 239/587.1 |
| 4,266,730 A | * | 5/1981 | Grohe | 239/587.5 |
| 6,257,505 B1 | * | 7/2001 | Wang | 239/526 |

* cited by examiner

*Primary Examiner*—Lisa A. Douglas
(74) *Attorney, Agent, or Firm*—Alan D. Kamrath; Rider, Bennet, Egan & Arundel

(57) ABSTRACT

A spray head with a pivotal nozzle having a body and a nozzle assembly pivotally connected to the body. The direction of the nozzle assembly relative to the body is able to be adjusted by a user in order to meet different situations. A switch is coupled to the body to provide convenient control of the water flow. A cap with various kinds of outlets is disposed on the nozzle assembly to produce different types of water jets.

20 Claims, 6 Drawing Sheets

SPRAY HEAD WITH A PIVOT NOZZLE

BACKGROUND OF THE INVENTION

1. Field of the Invention

The present invention relates to a spray head, and more particularly to a spray head having a pivot nozzle that is able to be adjusted in a direction relative to a body of the spray head.

2. Description of Related Art

Spray heads are widely used for various purposes, such as gardening, car washing . . . etc. In order to meet different situations and requirements, a lot of improvements have been made to the spray heads. For example, a spray head with different kinds of water outlets, such that different types of water jets can be selected. Another prior spray head has a switch which is able to shut off the water supply conveniently and so a user does not have to run all the way to a faucet which may be far away, thereby eliminating inconvenience when using a long hose.

However, a conventional spray head has a nozzle in which the direction thereof can not be changed relative to a body of the spray head. Although there are spray heads commonly available with nozzles of different angles relative to the spray heads, the user may have to purchase more than one spray head for different situations or have to endure the inconvenience in use.

To overcome the shortcomings, the present invention tends to provide a spray head to mitigate or obviate the aforementioned problems.

SUMMARY OF THE INVENTION

The primary objective of the present invention is to provide a spray head with a nozzle that is able to be directionally adjusted relative to a body of the spray head.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
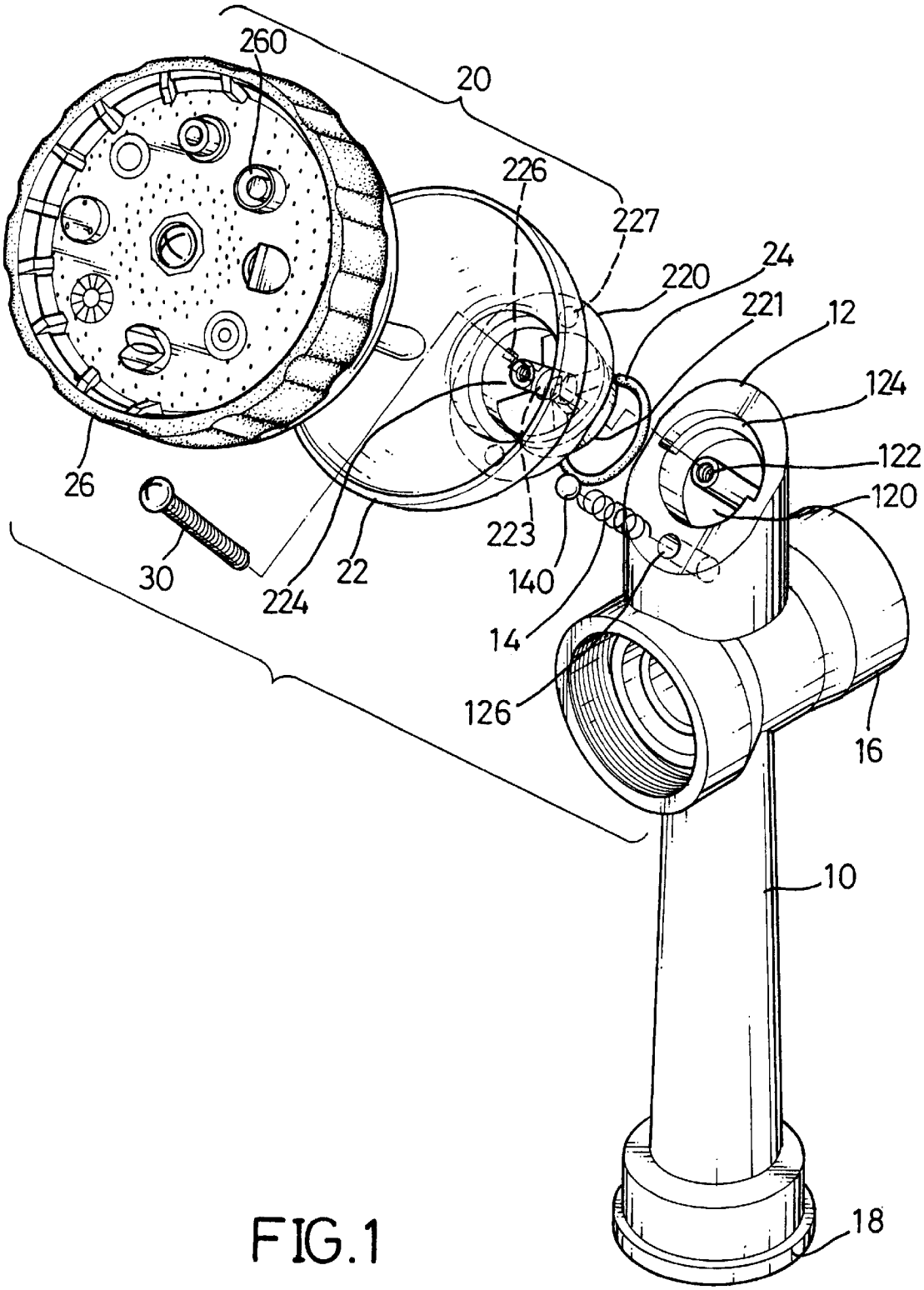
FIG. 1 is an exploded, perspective view of a spray head in accordance with the present invention.
Figure 2:
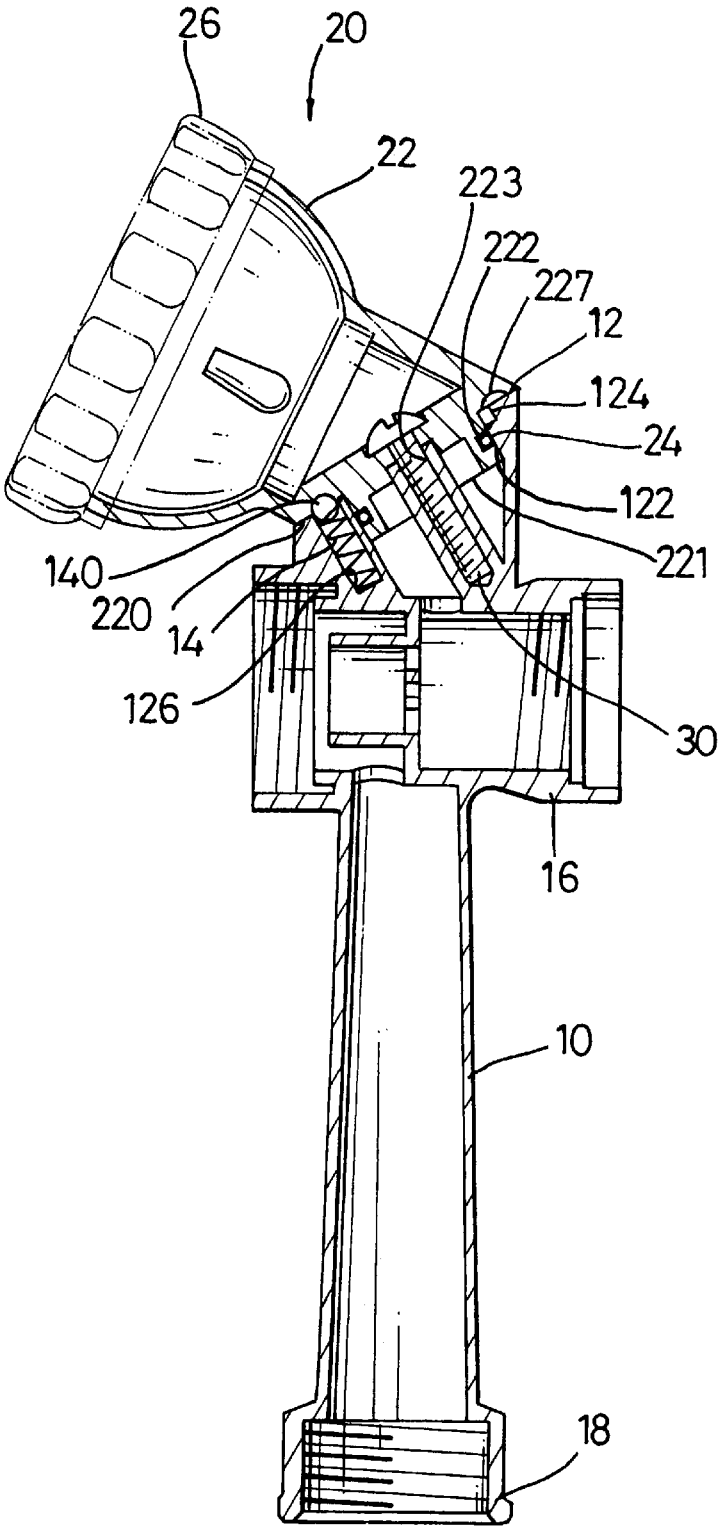
FIG. 2 is a cross-sectional view of the spray head with a nozzle pointed in a first direction.
Figure 3:
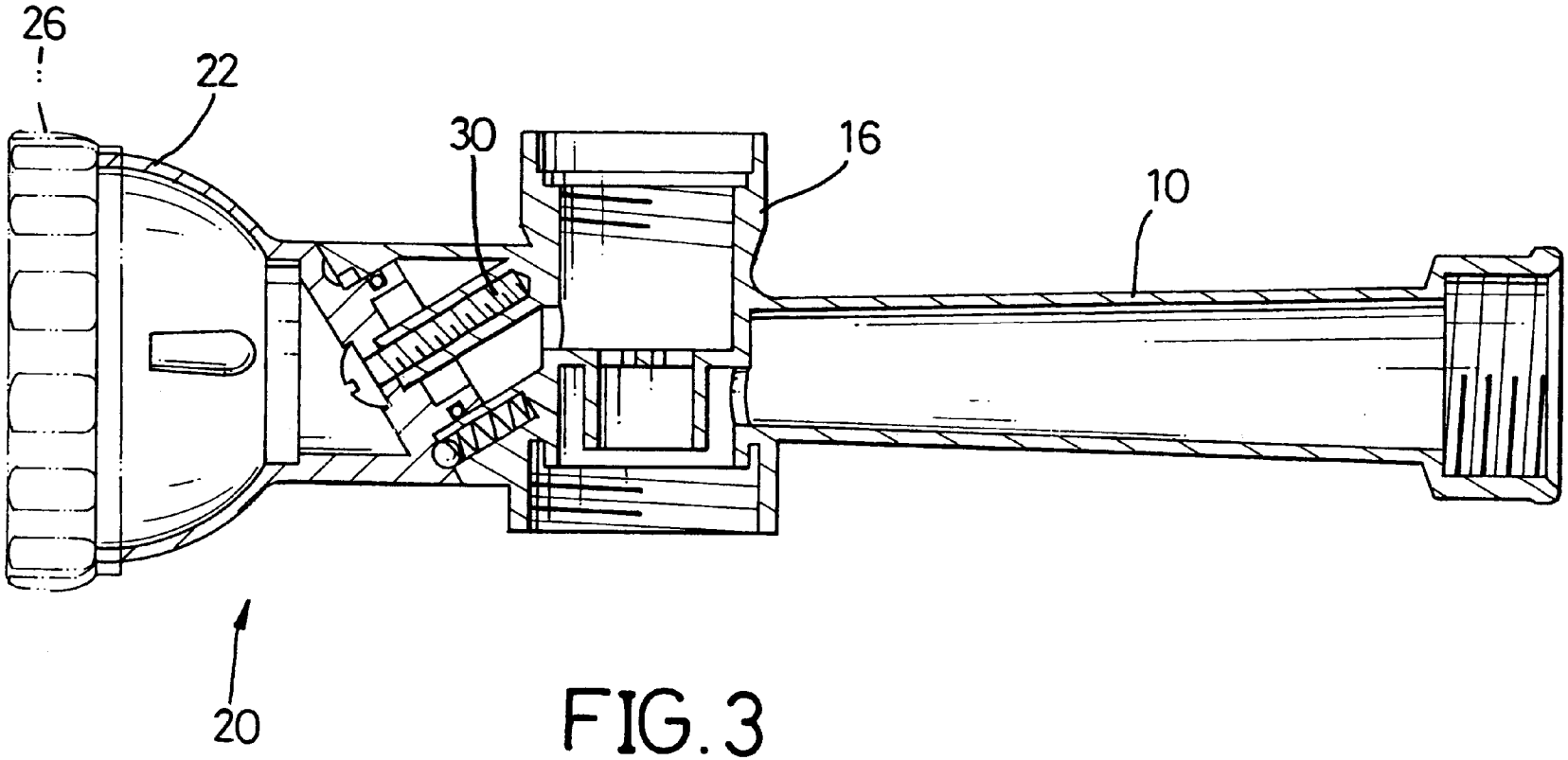
FIG. 3 is a cross-sectional view of the spray head with the nozzle pointed in a second direction.
Figure 5:
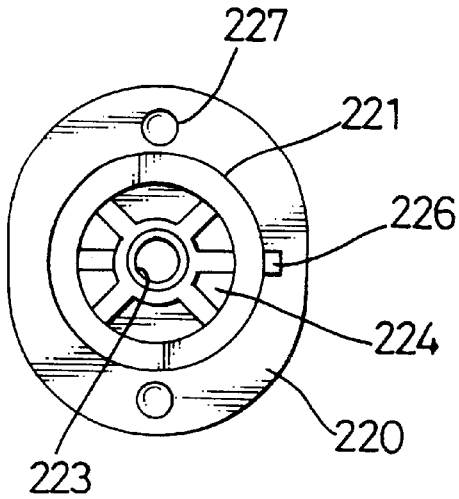
FIG. 5 is a cross-sectional view taken along the connecting surface between the nozzle assembly and the body, and showing the surface of the body.
Figure 4:
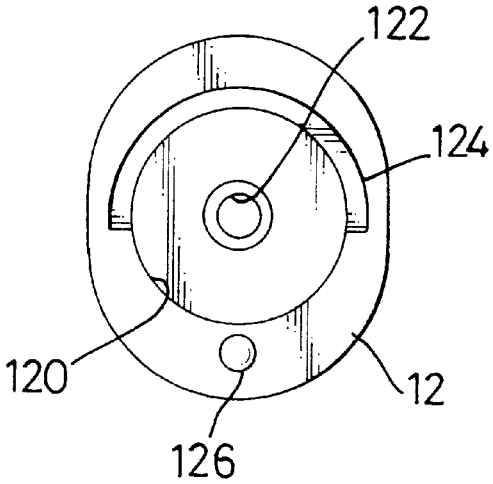
FIG. 4 is a cross-sectional view taken along a connecting surface between a nozzle assembly and a body of the spray head and showing a surface of the nozzle assembly.

With reference to FIGS. 1, 2 and 3, a spray head with a pivotal nozzle in accordance with the present invention includes a body (10) pivotally connected with a nozzle assembly (20).

The body (10) is a hollow member and has an inclined top surface (12) with a recess (120) defined therein. A screw tube (122) extends from the center of the recess (120). A restricting slot (124) is defined along the upper periphery of the recess (120), and a blind hole (126) is defined in the inclined top surface (12) outside the recess (120). The blind hole (126) has a spring (14) and a ball (140) inside forming a spring-ball combination for positioning the nozzle assembly (20) relative to the body (10).

The body (10) has a switch (16) coupled on the middle section of the body (10) to control the water that flows through the body (10). The detailed structure of the switch (16) is not the character of the present invention, thus excessive description is omitted. The body (10) also has a connector (18) formed on an opposed end with respect to the inclined surface (12) for connecting to a hose (40), shown in FIGS. 6 and 7, in order to provide a water supply.

The nozzle assembly (20) has a nozzle (22) with a bottom surface (220) that engages with the inclined top surface (12) of the body (10). A protrusion (221) having a configuration to mate with the recess (120) is formed on the bottom surface (220). A gasket (24) is disposed around the protrusion (221) to provide a watertight seal. A screw hole (223) is defined in the protrusion (221), and inlets (224) are defined adjacent to the screw hole (223) to communicate the body (10) and the nozzle (22). A restricting block (226) having a configuration to be received in the restricting slot (124) is formed on the corresponding portion of the bottom surface (220). Multiple cavities (227) are defined in the bottom surface (220), and the cavities (227) each are so configured and located in order to mate with the ball (140) of the springball combination for providing positioning of the nozzle assembly (20) and the body (10).

A cap (26) with various kinds of outlets (260) defined therein is fitted to the nozzle (22) to produce different kinds of water jets.

A screw (30) threadingly engages with the screw hole (223) and the screw tube (122) to connect the nozzle assembly (20) with the body (10).

When assembling the spray head, the protrusion (221) is received in the recess (120) with the gasket (24) disposed around the protrusion (221), and the restricting block (226) is received in the restricting slot (124). The screw (30) then threadingly engages with the screw hole (223) and the screw tube (122). Therefore, the nozzle assembly (20) is pivotally connected to the body (10) and is restricted in a certain range when rotating the nozzle assembly (20) by the restricting block (226) received in the restricting slot (124).

Figure 6:
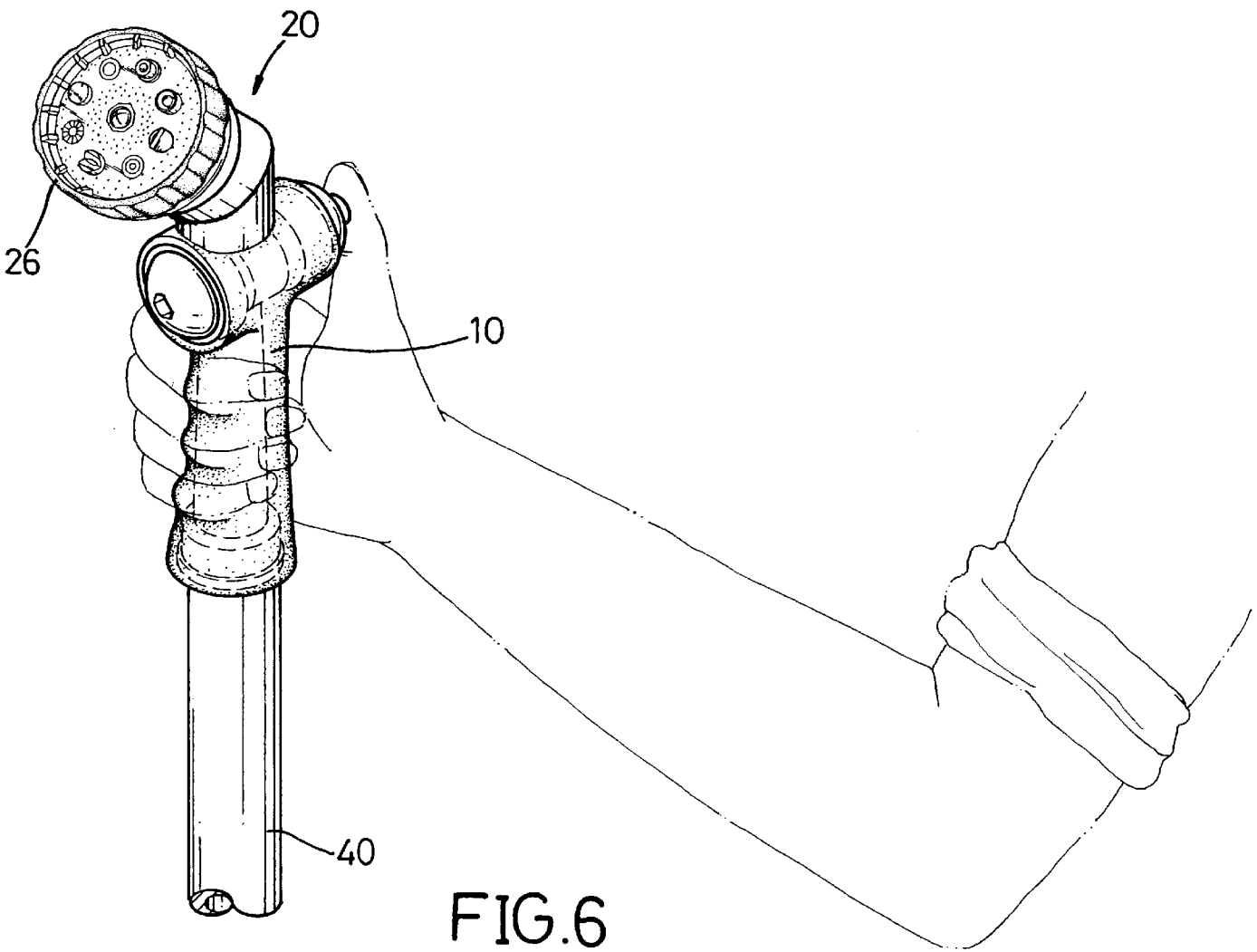
FIG. 6 is an operational, schematic view of the spray head with the nozzle pointed in the first direction.
Figure 7:
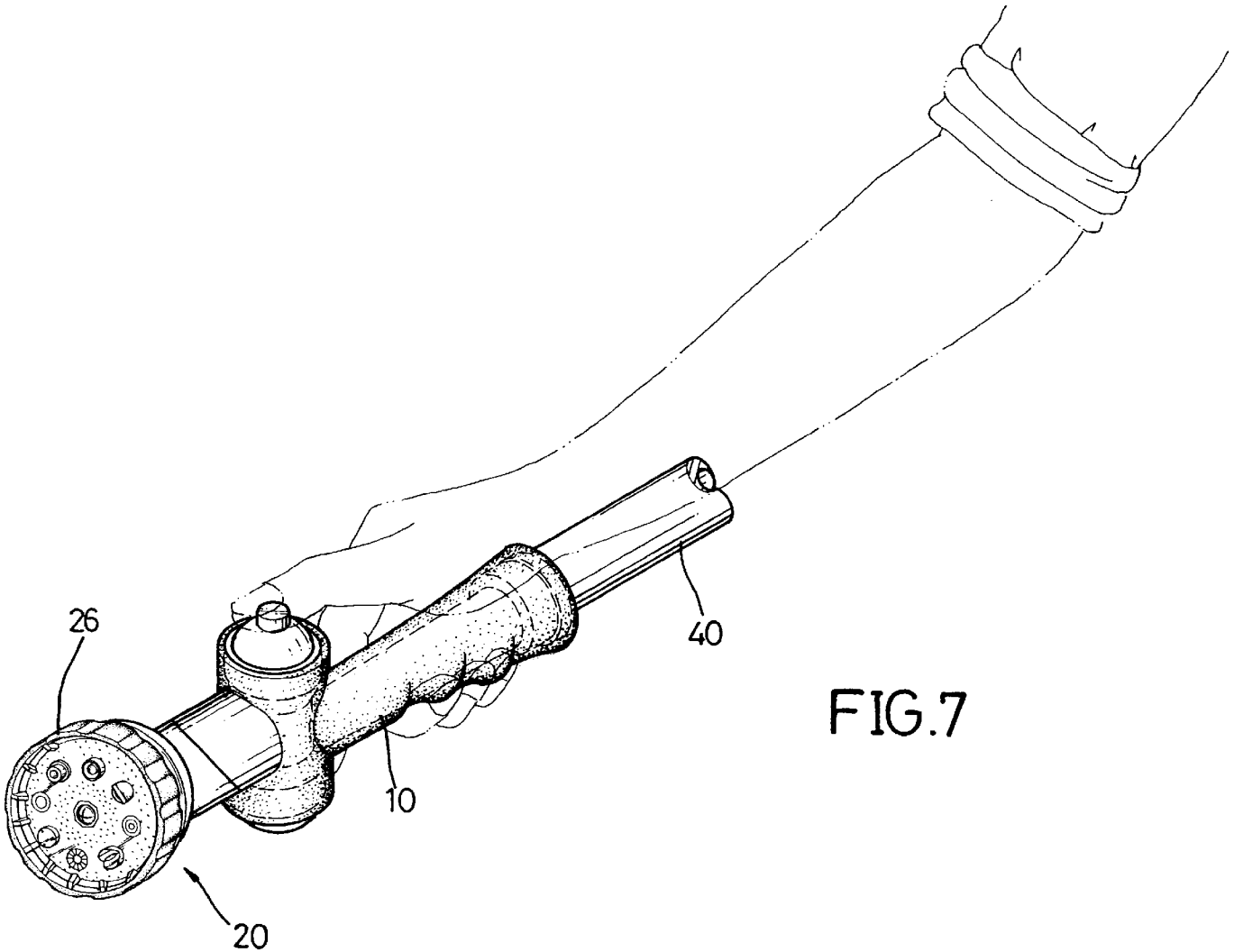
FIG. 7 is an operational, schematic view of the spray head with the nozzle pointed in the second direction.

In operation, the front face of nozzle assembly (20) can face one of the two different directions according to a user's choice. A first direction of the nozzle assembly (20) is shown in FIGS. 2 and 6. The front face of the nozzle assembly (20) is inclined with respect to the body (10). This direction is suitable for operation such like car washing. By rotating the nozzle assembly (20) 180 degrees with respect to the body (10), the front face of the nozzle assembly (20) faces the longitudinal direction of the body (10), as shown in FIG. 3. This direction in line with the body (10) is suitable for an operation such like gardening. The spring-ball combination together with the cavities (227) is able to provide secure positioning of the nozzle assembly (20) by slidingly receiving the ball (140) sequentially in the corresponding cavities (227) when the nozzle assembly (20) is set to the first or the second direction.

From the above description, it is noted that the invention has the following advantages:

1. application. The spray head in accordance with the present invention has a nozzle assembly (20) which is directionally adjustable in respect to the body. The nozzle assembly (20) can be selected to be either in line with the body (10) to be suitable for gardening, or inclined to the body (10) and thus suitable for car washing.
2. versatility. The spray head also has a cap (26) which has different kinds of outlets (260) to produce different kinds of water jets for various purposes.
3. convenience. The switch (16) coupled to the spray head is able to conveniently control the water jet, such that the user does not have to go all the way to the faucet to shut it off.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A spray head with a pivot nozzle comprising:

a hollow body having an inclined top surface and a recess defined in the inclined top surface;

a nozzle assembly having an inclined bottom surface formed to correspond to the inclined top surface of the hollow body and a protrusion formed on the inclined bottom surface of the nozzle assembly to be received in the recess, wherein when the protrusion is received in the recess, the nozzle assembly is able to pivotally and securely connect to the hollow body;

multiple cavities defined in the inclined bottom surface of the nozzle assembly; and a spring-ball combination inserted in a blind hole defined in the inclined top surface of the body, wherein each cavity selectively corresponds to the spring-ball combination whereby when the spring-ball combination is received in the corresponding one of the cavities, the nozzle assembly is able to be positioned with respect to the body.

2. The spray head with a pivot nozzle as claimed in claim 1 further comprising a restricting means formed between the nozzle assembly and the hollow body to limit the movement of the nozzle assembly within a degree with respect to the hollow body.

3. The spray head as claimed in claim 2, wherein the restricting means comprises a restricting slot defined along a periphery defining the recess, and a restricting block protruding from a side surface of the protrusion to be slidably received in the restricting slot.

4. The spray head with a pivot nozzle as claimed in claim 2, wherein the nozzle assembly has a cap disposed on the nozzle assembly, and the cap having different kinds of outlets to produce different types of water jets.

5. The spray head with a pivot nozzle as claimed in claim 1, wherein a switch is coupled to the body for controlling water flowing through the spray head.

6. The spray head with a pivot nozzle as claimed in claim 5, wherein the nozzle assembly has a cap disposed on the nozzle assembly, and the cap having different kinds of outlets to produce different types of water jets.

7. The spray head with a pivot nozzle as claimed in claim 6, wherein a gasket is disposed around the protrusion to provide a watertight seal.

8. The spray head with a pivot nozzle as claimed in claim 7, with the nozzle assembly pivotably and securely connected to the hollow body by a screw threadably extending into a screw hole in the protrusion and a screw tube which extends from a face defining the recess.

9. The spray head with a pivot nozzle as claimed in claim 1, wherein the nozzle assembly has a cap disposed on the nozzle assembly, and the cap having different kinds of outlets to produce different types of water jets.

10. The spray head with a pivot nozzle as claimed in claim 9, wherein a gasket is disposed around the protrusion to provide a watertight seal.

11. The spray head with a pivot nozzle as claimed in claim 10, with the nozzle assembly pivotably and securely connected to the hollow body by a screw threadably extending into a screw hole in the protrusion and a screw tube which extends from a face defining the recess.

12. The spray head with a pivot nozzle as claimed in claim 1, wherein a gasket is disposed around the protrusion to provide a watertight seal.

13. The spray head with a pivot nozzle as claimed in claim 12, with the nozzle assembly pivotably and securely connected to the hollow body by a screw threadably extending into a screw hole in the protrusion and a screw tube which extends from a face defining the recess.

14. The spray head with a pivot nozzle as claimed in claim 5, wherein a gasket is disposed around the protrusion to provide a watertight seal.

15. The spray head with a pivot nozzle as claimed in claim 14, with the nozzle assembly pivotably and securely connected to the hollow body by a screw threadably extending into a screw hole in the protrusion and a screw tube which extends from a face defining the recess.

16. The spray head with a pivot nozzle as claimed in claim 1, with the nozzle assembly pivotably and securely connected to the hollow body by a screw threadably extending into a screw hole in the protrusion and a screw tube which extends from a face defining the recess.

17. The spray head with a pivot nozzle as claimed in claim 3, wherein a switch is coupled to the body for controlling water flowing through the spray head.

18. The spray head with a pivot nozzle as claimed in claim 17, wherein the nozzle assembly has a cap disposed on the nozzle assembly, and the cap having different kinds of outlets to produce different types of water jets.

19. The spray head with a pivot nozzle as claimed in claim 18, wherein a gasket is disposed around the protrusion to provide a watertight seal.

20. The spray head with a pivot nozzle as claimed in claim 19, with the nozzle assembly pivotably and securely connected to the hollow body by a screw threadably extending into a screw hole in the protrusion and a screw tube which extends from a face defining the recess.

* * * * *